United States Patent [19]

Le Page

[11] Patent Number: 4,523,767

[45] Date of Patent: Jun. 18, 1985

[54] THREE WHEELED ROLLER SKATE

[76] Inventor: Steven W. Le Page, Rte. 5, Box 5125, Pasco, Wash.

[21] Appl. No.: 440,972

[22] Filed: Nov. 12, 1982

[51] Int. Cl.[3] ..... A63C 17/04

[52] U.S. Cl. ..... 280/11.19

[58] Field of Search ..... 280/11.19, 11.23, 11.22, 280/87.04 A, 87.04 R, 62, 11.27, 11.1 R, 661

[56] References Cited

U.S. PATENT DOCUMENTS

| | | | |
|---|---|---|---|
| 1,211,557 | 1/1917 | Dore | 280/11.19 |
| 1,276,212 | 8/1918 | Hardy | 280/11.19 |
| 1,854,188 | 4/1932 | Gregory | 280/11.19 |
| 3,086,787 | 8/1960 | Wyche | 280/11.19 |
| 3,339,936 | 9/1967 | Hamlin | 280/11.23 |
| 3,891,225 | 6/1975 | Sessa | 280/11.19 |
| 4,138,127 | 2/1979 | Kimmell | 280/11.23 |
| 4,146,241 | 3/1979 | Stevenson | 280/11.27 |
| 4,332,394 | 6/1982 | Klawitter | 280/11.19 |

FOREIGN PATENT DOCUMENTS

| | | | |
|---|---|---|---|
| 591087 | of 1933 | Fed. Rep. of Germany | 280/11.1 R |
| 221445 | 9/1924 | United Kingdom | 280/11.19 |

*Primary Examiner*—Joseph F. Peters, Jr.
*Assistant Examiner*—Joseph G. McCarthy
*Attorney, Agent, or Firm*—Wells, St. John & Roberts

[57] ABSTRACT

A three wheeled roller skate includes unique features that enable safe and continuous use over rough or smooth terrain. A pair of rollers are situated below the skater's heel and a single roller is situated at the front, under the skater's toes. The single front roller is mounted on a rotational axis that is angled in relation to the axis for the rear wheels. The front roller includes a "toe-out" angle and an inside camber angle to assist tracking and maneuverability. The skate frame and rollers are also arranged to incline the skater's feet, with the toes lower than the heels in order to shift the center of gravity forward of the heels to add balance stability.

17 Claims, 3 Drawing Figures

THREE WHEELED ROLLER SKATE

FIELD OF THE INVENTION

The present invention relates to roller skates in general and more particularly to three wheeled roller skates.

BACKGROUND OF THE INVENTION

The popularity of roller skating has increased significantly with the advent of new synthetic materials to replace the old wood, metal, or hard rubber skate rollers. The new materials have enabled use of roller skates, not only in the skate rinks, but also on ordinary paved surfaces. Overall skate design, however, has not changed. The most popular skates still make use of four rollers per skate; two rollers under the toes and two under the heel.

Conventional roller skates are heavy and cumbersome, especially in the toe area, due to the roller weight and supporting truck structure. The usual distribution of weight on the foot is difficult to adjust to and can cause fatigue. Furthermore, the wide stance of the two front rollers forces the skater to move unnaturally when propelling forward or rearwardly. An effort is typically made to keep all four rollers of both skates on the floor or pavement at all times, thereby maximizing control and balance. However, the skate and roller configuration is such that the feet and legs must be contorted into uncomfortable positions when moving, especially over uneven terrain.

Excessive toe weight added by the foot rollers tends to tip the skates forwardly, so the toe rollers are first to touch ground as the skater steps forwardly after "pushing off". This seldom causes problems in roller rinks but can be potentially dangerous in rougher terrain where the front rollers might catch on some obstacle and trip the skater. It is more desirable to lower the rear rollers to the pavement first. Then, if an object is encountered, the front rollers are available to add stability while the rear rollers move over the obstacle. The difficulty is in holding the toes high to let the rear rollers touch first. The muscles used to hold the toes high become easily fatigued and often develop into relatively serious and painful "shin splints".

Design of four wheel roller skates has conventionally been ignored insofar as human anatomy is concerned. Human body weight is not evenly distributed between the heel and toe. Much more weight is borne by the heels than the toes. Also, the overall body weight is centered between the feet rather than centered over each foot. Four wheel roller skates use truck mounts for the rollers that, due to bulk of the trucks, tend to shorten the skate wheel base. The further forward the rear wheels, the more tendency there is for the wheels to shift forwardly suddenly, causing a fall. The same is true of rearward location behind the ball of the foot of the forward rollers.

The laterally centered weight of a skater naturally causes more weight to be borne at the inside of the foot than the outside. Four wheel roller skate trucks are designed to track straight under direct vertical loading. Thus, there is a natural tendency for the skates to "stee" themselves inwardly when the skater's weight is naturally applied to the rollers and trucks. The skater therefore accommodates for this by shifting more weight to the outside surfaces of the feet.

In short, it has continually been the skater making adjustments to accommodate the skate roller placement and geometry of the skates, rather than the skate roller geometry accommodating the skater. This causes safety as well as muscle strain problems, especially when skates are used outdoors over rough terrain and over long periods of time.

These problems have been recognized to a limited extent by previous developers of three wheel roller skates. For example, the 1963 U.S. Patent to Wyche (3,086,787) discloses a three wheel roller skate having a single front roller and dual rear rollers as an answer to part of the difficulties experienced with four roller skates. However, the patent deals primarily with a rigid roller support framework, rather than attending to the several drawbacks remaining even through provision of a single, rather than double, front roller. For example, positioning of the front roller appears to be somewhat behind the "ball" of the toes. The heel, on the other hand, is situated forwardly of the skater's heel. This causes a relatively short wheel base that decreases stability, especially in rough terrain. Furthermore, the rotational axes of the front and rear rollers appear to be parallel. Thus, the Wyche skates will track forwardly or rearwardly only under vertical loading.

Another three wheel roller skate is disclosed by Sessa in U.S. Pat. No. 3,891,225. Sessa, however, was concerned with simulating a snow ski. The "wheel base" between forward and rearward rollers is not confined within the limits of the skater's foot length. Instead, the rollers of the Sessa device are situated in front of and behind the footrest or support. This severely limits the maneuverability of the skater but, nontheless, points further to the advantages of a three roller skate. A similar skate is shown in U.S. Pat. No. 1,854,188 to Gregory.

Another three roller skate is shown by U.S. Pat. No. 1,276,212 to Hardy. Hardy, like Wyche, was concerned primarily with frame rigidity but did recognize the advantages of utilizing three skate rollers for additional stability. The same difficulties remain, however, of improving the safety and comfort of the skate design for use over various terrain.

A substantial need, therefore, remains for roller skates that may use the advantages of the newly developed synthetic rollers, while minimizing the safety risks previously associated with four wheel roller skates, especially in uneven terrain conditions and, further, which will add to the comfort of the skater during long skating sessions.

BRIEF DESCRIPTION OF THE DRAWINGS

A preferred embodiment of the present invention is illustrated in the accompanying drawings in which.

DETAILED DESCRIPTION

Figure 1:
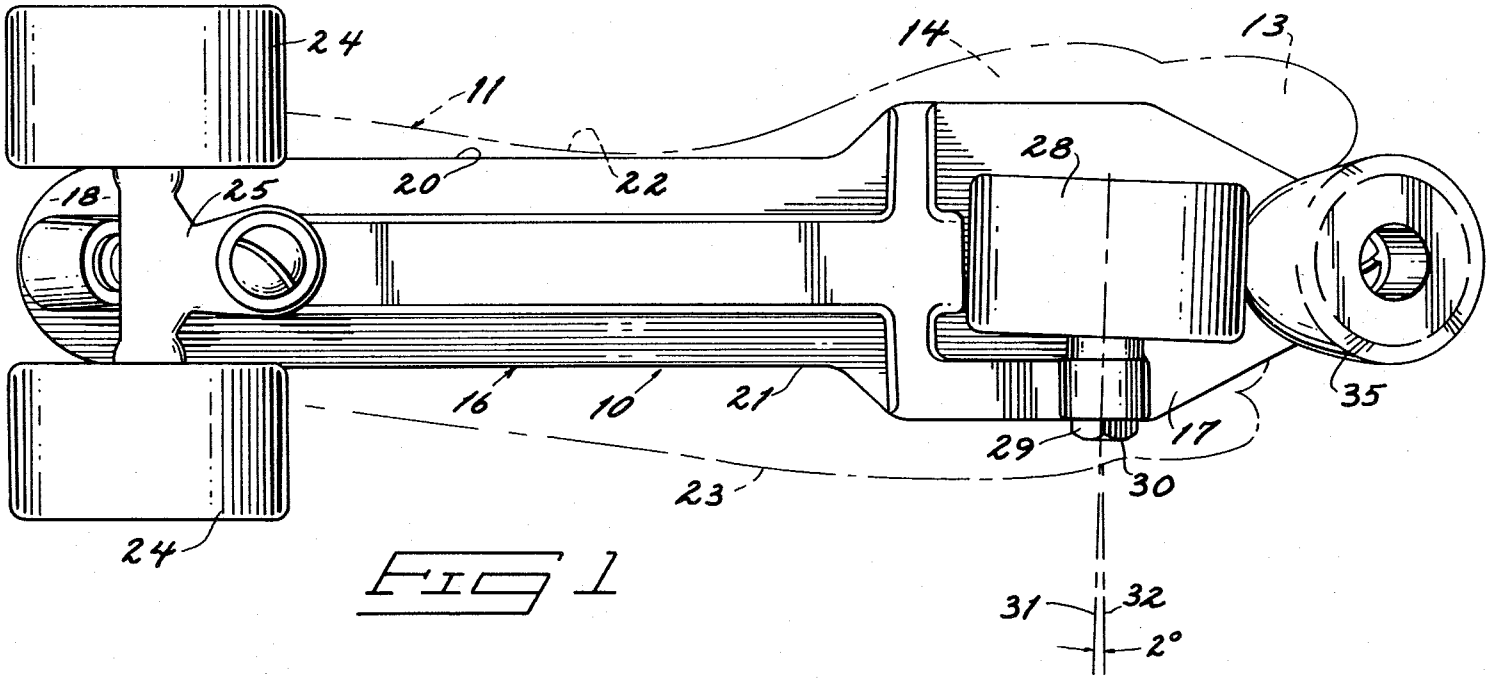
FIG. 1 is a bottom plan view of the present skate for the left foot of a skater.

In compliance with the constitutional purpose of the Patent Laws "to promote the progress of science and useful arts" (Article 1, Section 8), applicant submits the following disclosure of the invention.

A skate embodying the principal features of the present invention is illustrated in the drawings and is designated therein by the reference numeral 10. The skate 10 shown in the drawings is one of a pair. More specifically, the left skate of a pair is shown; the right skate being the direct opposite or mirror image thereof. Therefore, description of the single skate illustrated will suffice for description of the remaining skate for a pair.

Figure 2:
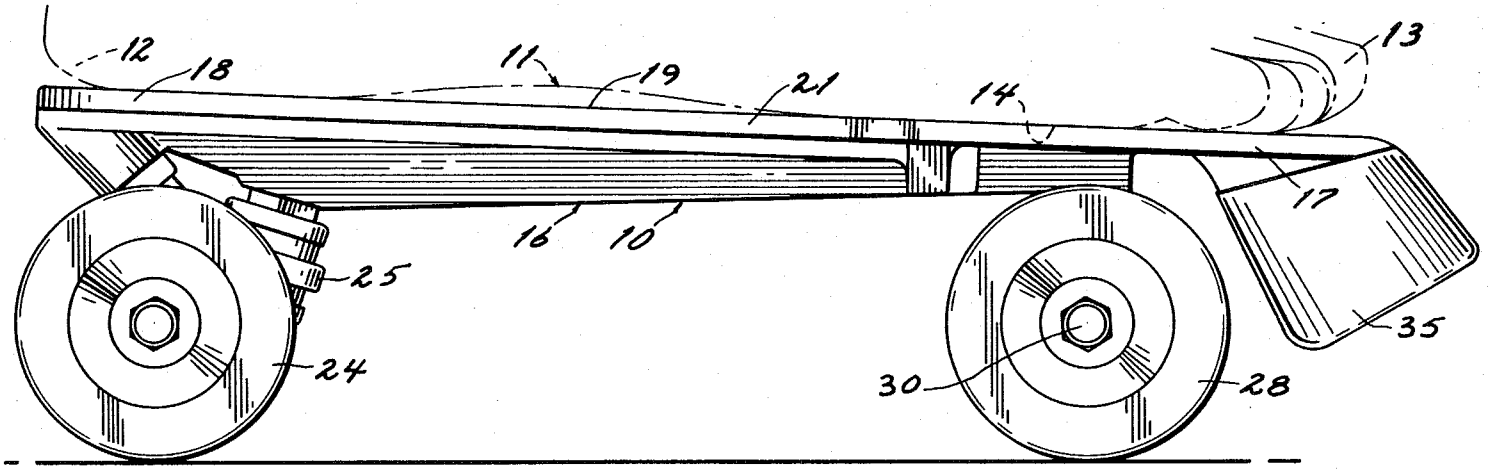
FIG. 2 is a side elevational view.

FIGS. 1 and 2 show a dashed outline of a skater's foot 11 in position in relation to the components of the present skate 10. For purposes of further description, it is pointed out that the foot 11 includes a heel 12 and toes 13 forwardly of the ball 14 of the foot. The "ball" 14 is intended, for this description, to be the enlarged base of the great or "big" toe.

The present skate 10 includes an elongated rigid frame 16 extending between a front end 17 and a rear end 18. An upper foot support surface 19 is provided along the frame 16 to support the weight of a skater. Actually, this surface will most probably be securely attached by conventional fastening mechanisms, to a standard form of foot or shoe (not shown) used for conventional skating.

The frame 16 includes an inside edge 20 and a substantially parallel and opposite outside frame edge 21. These edges correspond respectively to the inside and outside surfaces of the skater's foot. The inside surface is diagrammatically indicated in FIG. 1 at 22 and the outside foot surface is similarly shown at 23.

The rigid frame 16 supports a pair of wheels or rollers 24 at the rearward frame end 18. The rear rollers 24 are mounted to the frame by a conventional truck mechanism 25 that will allow selective pivotal motion of the rear wheels about a longitudinally oriented truck axis. The truck mechanism is of conventional form. Its position, however, is to be on the frame directly below the skater's heel 12. The position of the truck along the frame allows mounting of the rear rollers 24 to minimize distribution of the skater's weight behind the rear wheel axis.

It is important to note that the axis for the rear rollers is transverse to the length of the frame. This is the normal operating orientation for the rollers 24 as determined by the truck mechanism 25, although the mechanism 25 will allow some shifting of the truck support and rollers 24 in the manner of conventional truck and roller arrangement for roller skates.

A front wheel or roller 28 is situated along the frame 16 at the front end 17. The front roller is mounted to the frame by a rigid front roller axle mount 29. The axle mount 29 (FIGS. 1, 3) may be an integral part of the frame 16, extending vertically downward from the outside frame edge 21.

It is important to note the position of the axle mount 29 in relation to the skater's foot. The axle mount is situated toward the outside surface 23 of the skater's foot. Therefore, there is little danger that the mount 29 will scrape against the ground or other support surface as the skater turns or thrusts forward or rearwardly. The typical thrusting motion of the foot involves tipping of the skate to the inside and "pushing off" with the inside edge and toe of the foot. The axle mount 29, if positioned on the inside edge, would inhibit this natural motion. Therefore, it is placed along the outside edge to completely free the area adjacent the front roller for maneuvering or thrusting for propulsion.

The front wheel axle mount 29 is situated along the frame to be positioned directly below the ball 14 of the skater's foot. This position is typically at least one inch further from the rear rollers than are the front rollers of ordinary four wheel skates. The absence of a front truck arrangement facilitates the further forward position of the front roller 28 and significantly adds to stability of the skate as well as comfort and safety to the skater. The actual position of the front axle mount 29 in relation to the rear rollers 24, of course, will vary with the foot size of the skater. The frames, then, will be produced in varying lengths to accommodate various skater foot sizes.

An axle shaft 30 (FIG. 2) is secured to the front axle mount 29 to freely rotatably receive the front roller 28. The axle shaft 30 may be oriented angularly as described below in relation to the rear roller axis and to a horizontal plane in order to appropriately position the front roller selectively to accommodate the weight and physical characteristics of the human form.

The rotational axis defined by the axle shaft 30 is shown in FIG. 1 by the center line 31. A reference line 32 is also shown. The line 32 is parallel to the rotational axis for the rear rollers 24. The relationship of the axis 31 and line 32 shown an angular "toe out" orientation for the front roller 28.

The "toe out" orientation is an outward angle in relation to the skater's foot, included between axis 31 and reference line 32 of less than six degrees. Preferably, the angle is approximately two degrees to accommodate the natural weight distribution of the human form toward the inside surfaces of the feet. By situating the front roller 28 at a two degree "toe out" orientation, the skater can stand in a perfectly natural orientation without consciously or subconsciously shifting weight to the outside foot surfaces to avoid inward tracking of the skates. The result is somewhat of a "crabbing" effect since the rear rollers 24 do not follow precisely behind the front roller 28. Handling and stability are not affected by this seemingly odd tracking orientation. On the contrary, the more natural weight distribution over the skates lends more confidence and balancing ability to the skater who is then able to concentrate more fully on other techniques of balance and propulsion.

Figure 3:
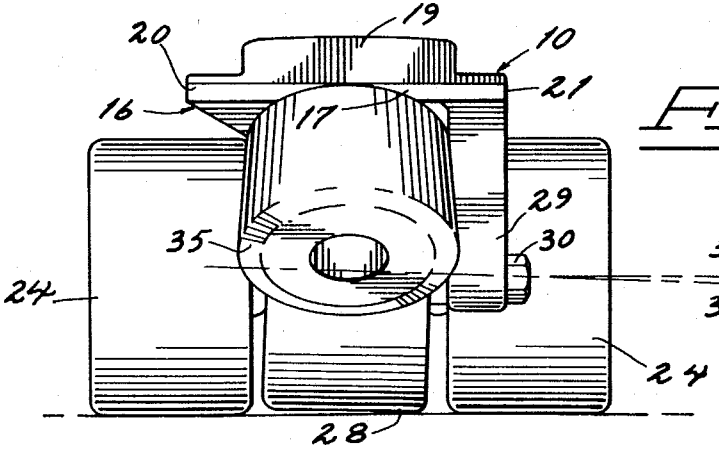
FIG. 3 is a front elevation view thereof.

Along with the "toe out" orientation, it is desirable to include an inside chamber of the front roller 28. This relationship is best shown with reference to FIG. 3. In FIG. 3, a horizontal plane is diagrammatically indicated at 34 intersecting the roller axis 31. The "camber", then, is to the inside in relation to the skater's foot in order to shift the weight applied to the skate laterally inward. This, along with the "toe out" accommodates the natural weight distribution of the skater and increases stability by concentrating the load within the space occupied by the skater's body.

The inside camber angle may be up to six degrees inclusive between the axis 31 and horizontal plane 34. Preferably, however, this angle is also two degrees, corresponding to the preferred two degree "toe out" angular orientation. The two degree camber not only provides for the skater's natural weight distribution, but also, in conjunction with the two degree "toe out", allows increased mobility by enabling faster turning potential. The camber, in effect, pretilts the front roller appropriately to more securely frictionally engage against the ground surface during turns, thereby allowing faster turning.

A conventinal brake pad 35 is mounted to the frame 16 at the front end 17. The pad can be used for slowing and stopping in the same manner as conventional skates. The skate need simply be tipped upwardly to bring brake pad 35 into engagement with the support surface, to frictionally rub against the support surface and thereby slow momentum of the skater.

An important feature of the present invention is the interrelationship between the frame and rollers 24 and 28 to produce a forward inclination of the frame and associated skater's foot. This arrangement is made to maintain a normal elevation of the skater's toes 13 somewhat lower than the corresponding surfaces of the skater's heel 12. This may be done by decreasing the vertical distance between the axis 31 of the front roller to support surface 19 with regard to the corresponding distance between the rear roller axis and surface 19. The result is a forward "rake" angle, preferably less than six degrees from the horizontal, that is utilized to slightly shift the weight applied to the skate forward of the heel and more directly between the front and rear rollers. This weight shift is desirable since the natural weight distribution to the feet is only just slightly forward of the heel. There is less tendency with the present "rake" angle, for the rollers to roll "out from under" the skater. The slight forward shifting of the skater's weight tends to add stability by more evenly distributing weight of the skater between the rollers.

An additional advantage to the forward inclination is understood by a forwardly moving skater. The natural tendency when moving forwardly is to lean somewhat forwardly. The natural orientation when standing is a perpendicular angle between the foot and leg. The frame inclination will allow for such a perpendicular relationship while still enabling the skater to lean forwardly. This causes significantly less strain on the skater's leg muscles.

The lower elevation of the skater's toes also serves to slightly lower the skater's center of gravity. Though seemingly insignificant, this feature, along with the previously indicated increase of wheel base, and extra weight distribution affords a very noticeable increase in ease of control and balance when using the present skate. The even weight distribution afforded by the toe out and camber features also add to stability. The overall feeling, therefore, is an increased, secure feeling of added safety and confidence in functioning with the present skates over a variety of terrain.

Greater comfort and safety is realized by provision of the single front roller and inclined orientation of the frame. Firstly, the single front roller reduces weight of the skate at the toe end. Therefore, there is substantially less toe weight for the skater to lift and, consequently, there is less of an effort involved in allowing the heel to touch the floor surface first when setting the skate down following a thrusting movement. Furthermore, the forward inclination of the frame allows lifting of the foot without the front roller dragging along and interfering with turning. The lower front and weight of the present skate on the skater's foot significantly reduces ordinary muscle strain and allows for longer, more effortless, skating sessions.

Location of the single front roller at the forward end of the skate also allows for a more perpendicular angle for "kickoff" when thrusting forward or rearwardly. This is so because the front roller is situated at or near the lateral center of the foot so the skater does not have to turn the skate as far out from the direction of travel in order to have a firm base (surface of the roller 28) to thrust from.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims, appropriately interpreted in accordance with the doctrine of equivalents.

I claim:

1. A three wheeled roller skate, comprising;

an elongated rigid frame having a front and rear end and adapted to receive the foot of a skater with the toes of the foot situated above the front frame end and the heel above the rear frame end;

a rear pair of rollers mounted to the frame at the rear end thereof, for free rotation about an axis transverse to the frame;

a single front roller at the front frame end for free rotation thereon about an axis situating the front roller in an outward angled toe out orientation and at an inside cambered orientation in relation to the rear roller axis and the foot of a skater resting on the frame such that the weight of the skater borne by the front roller is shifted laterally inward toward the midline of the skater's body to accommodate natural weight distribution of the skater and to increase stability by concentrating the skater's weight within the space occupied by the skater's body.

2. The three wheeled roller skate as claimed by claim 1 wherein the front roller is angled to toe out from the frame by an angle of up to six degrees from a reference line parallel to the axis of the rear rollers.

3. The three wheeled roller skate as claimed by claim 1 wherein the front roller is angled to toe out from the frame by an angle of approximately two degrees from a reference line parallel to the axis of the rear rollers.

4. The three wheeled roller skate as claimed by claim 1 wherein the inside camber angle is up to six degrees from a horizontal plane.

5. The three wheeled roller skate as claimed by claim 1 wherein the inside camber angle is approximately two degrees from a horizontal plane.

6. The three wheeled roller skate as claimed by claim 1 wherein the front roller is angled to toe out from the frame by an angle of up to six degrees from a reference line parallel to the axis of the rear rollers; and wherein the front roller is also angled, in addition to the toe out orientation, in an inside cambered orientation in relation to a horizontal plane of up to six degrees from the horizontal plane.

7. The three wheeled roller skate as claimed by claim 1 wherein the rollers and frame cooperate to produce a forwardly inclined foot support surface aklong the frame for shifting weight of the skater toward the toes from the natural area of weight distribution adjacent the skater's heel.

8. The three wheeled roller skate as claimed in claim 7 wherein the forward incline is less than six degrees from a horizontal plane.

9. The three wheeled roller skate as claimed by claim 1 wherein the frame includes longitudinal inside and outside edges corresponding to the inside and outside surfaces of a skater's foot and further comprises:

a front axle mount on the frame at the front end thereof extending downwardly from the outside frame edge; and wherein the single front roller is freely rotatably mounted to the front axle mount and projects inwardly therefrom in relation to the inside and outside edges of the frame.

10. The three wheeled roller skate as claimed by claim 1 wherein:

the front roller is angled to toe out from the frame by an angle of up to six degrees from a reference line parallel to the axis of the rear rollers;

the frame includes longitudinal inside and outside edges corresponding to the inside and outside surfaces of a skater's foot and further comprises:

a front axle mount on the frame at the front end thereof extending downwardly from the outside frame edge; and wherein the single front roller is freely rotatably mounted to the front axle mount and projects inwardly therefrom in relation to the inside and outside edges of the frame.

11. A three wheeled roller skate, comprising:

an elongated rigid frame having a front end and a rear end, and a top support surface adapted to receive a skater's foot with the front frame end situated below the skater's toes and the rear frame end being situated below the skater's heel;

a pair of freely rotatable rollers mounted for rotation about a rear wheel axis on the frame at the rear end thereof;

a single roller mounted for rotation about a front wheel axis on the frame at the front end thereof and transversely centered below the ball of the skater's foot; and wherein the rollers and frame are arranged to hold the skater's foot with the toes thereof at a lower elevation than the heel, for shifting a skater's weight to a point between the front and rear rollers and to support the skater's foot in an inwardly inclined orientation such that the weight of the skater is shifted laterally inward, wherein the rotational axis of the front wheel is offset angularly horizontally and vertically relative the rear wheel axis such that the weight of the skater borne by the front roller is shifted laterally inward toward the midlne of the skater's body to accomodate natural weight distribution of the skater and to increase stability by concentrating the skater's weight within the space occupied by the skater's body.

12. The three wheeled roller skate as claimed by claim 11 wherein the frame includes an upper support surface for receiving a skater's foot and wherein the support surface is inclined forwardly with respect to a horizontal plane by an angle of less than six degrees.

13. The three wheeled roller skate as claimed by claim 11 wherein the frame includes a front axle mount and a rear wheel truck for rotatably mounting the front and rear rollers respectively about front and rear roller axes spaced from the frame and wherein the rear wheel axis is spaced from the frame by a vertical distance greater than the vertical distance between the frame and the front roller axis.

14. A three wheeled roller skate, comprising:

an elongated rigid frame having a front end, a rear end, and a top support surface adapted to receive a skater's foot, with the front frame end situated below the skater's toes and the rear frame end being situated below the skater's heel, and with an inside edge of the frame extending along the inside of the skater's foot and an outside edge of the frame extending along the outside of the skater's foot;

a pair of freely rotatable rollers on the frame at the rear end thereof;

a front axle mount adjacent the front frame end extending downwardly from the outside edge of the frame;

a single roller freely rotatable on the front axle mount and extending inwardly therefrom; and wherein the front axle mount is integral with the frame and is oriented to center the front roller below a skater's foot at the toes thereof at an inside cambered orientation in relation to a horizontal plane and at an outward angled toe out orientation in relation to the rear rollers to shift the weight of a skater laterally inward.

15. The three wheeled roller skate as claimed by claim 14 further comprising:

a brake pad mounted to the frame at the front end thereof directly in front of the front roller.

16. The three wheeled roller skate as claimed by claim 14 wherein the front roller axis is fixed and the rear rollers are mounted to the frame by a truck mechanism that will allow selective pivotal motion of the rear rollers about a longitudinal truck axis.

17. The three wheeled roller skate as claimed by claim 14 wherein the front and rear rollers are positioned in relation to the frame to be situated in relation to a skater's foot on the frame, with the front roller being situated directly below the ball of the foot and the rear rollers being situated directly below the heel of the foot.

* * * * *